US009733039B2

(12) United States Patent
Mezynski et al.

(10) Patent No.: US 9,733,039 B2
(45) Date of Patent: Aug. 15, 2017

(54) DEBRIS CONTROL APPARATUS

(71) Applicant: AIRTRONIC USA, LLC, Spring Branch, TX (US)

(72) Inventors: Ryan Mezynski, Spring Branch, TX (US); Mike Byars, Spring Branch, TX (US)

(73) Assignee: AIRTRONIC USA, LLC, Spring Branch, TX (US)

( * ) Notice: Subject to any disclaimer, the term of this patent is extended or adjusted under 35 U.S.C. 154(b) by 0 days.

(21) Appl. No.: 15/292,049

(22) Filed: Oct. 12, 2016

(65) Prior Publication Data

US 2017/0102204 A1 Apr. 13, 2017

Related U.S. Application Data

(60) Provisional application No. 62/240,403, filed on Oct. 12, 2015.

(51) Int. Cl.

| | |
|---|---|
| ***F41F 3/04*** | (2006.01) |
| ***F41A 35/02*** | (2006.01) |
| ***F41F 3/045*** | (2006.01) |
| ***F41G 1/46*** | (2006.01) |

(52) U.S. Cl.

CPC ..... *F41A 35/02* (2013.01); *F41F 3/0455* (2013.01); *F41G 1/46* (2013.01)

(58) Field of Classification Search

USPC ..... 89/1.816, 1.817, 1.815; 42/134, 96, 143

See application file for complete search history.

(56) References Cited

U.S. PATENT DOCUMENTS

| | | | | |
|---|---|---|---|---|
| 2,383,466 A * | 8/1945 | Brown | F41G 1/545 | 42/134 |
| 3,750,529 A * | 8/1973 | Reed | F42B 15/00 | 89/1.8 |
| 4,895,061 A * | 1/1990 | Baricos | F41F 3/0455 | 89/1.814 |
| 7,520,204 B2 * | 4/2009 | Williams | F41F 3/077 | 220/200 |
| 7,954,412 B2 * | 6/2011 | Jansson | F41F 3/077 | 89/1.817 |

* cited by examiner

*Primary Examiner* — J. Woodow Eldred
(74) *Attorney, Agent, or Firm* — Polsinelli PC

(57) ABSTRACT

Debris control apparatus for a rocket propelled grenade launcher including a plug configured to be inserted into an opening at a rear end of a tube assembly of the rocket propelled grenade launcher, the plug forming an aperture at about the center thereof. A front cover configured to be coupled with a front end of the rocket propelled grenade launcher and configured to cover an inlet, at the front end, that receives a rocket propelled grenade. The front cover is configured to provide cross-hairs and the aperture cooperating to provide, when a target is provided down range at a predetermined distance, a bore sight with the cross-hairs and the front cover and plug cooperatively, when installed, seal the rocket propelled grenade launcher assists in preventing ingress of debris.

18 Claims, 12 Drawing Sheets

Section A-A

DEBRIS CONTROL APPARATUS

CROSS-REFERENCE TO RELATED APPLICATION

This application claims benefit of U.S. provisional application Ser. No. 62/240,403 filed Oct. 12, 2015, and which is entirely incorporated by reference herein.

FIELD

The present disclosure relates to rocket propelled grenade launchers. More specifically, the disclosure relates to a debris control apparatus for a rocket propelled grenade launcher.

BACKGROUND

Rocket Propelled Grenade (RPG) launchers are among the most widely used anti-armor weapons in the world. RPG launchers are know for their ruggedness, simplicity, low cost, and effectiveness. There are a number of countries utilizing RPG technology and is manufactured in a number of variants. RPGs have been used in almost every armed conflict in the world since the mid-1960s from the Vietnam War and Kosovo to current conflicts in Iraq, Afghanistan, Syria, and throughout Africa.

RPG launchers are reloadable, anti-armor weapons configured to fire a selection of warheads. RPG launchers have a 40 mm launch tube, but warheads are not limited to the size of the launch tube. A wide variety of warheads are currently available including anti-personnel, anti-tank, anti-structure, tandem, and thermobaric rounds.

The RPG has remained relatively unchanged since its initial design. Current RPG launchers have an open ended tube, exposed at the front and rear end, to the environment and environmental conditions that exist during use, transportation, and storage.

BRIEF DESCRIPTION OF THE DRAWINGS

Implementations of the present technology will now be described, by way of example only, with reference to the attached figures, wherein.

DETAILED DESCRIPTION

Figure 1:
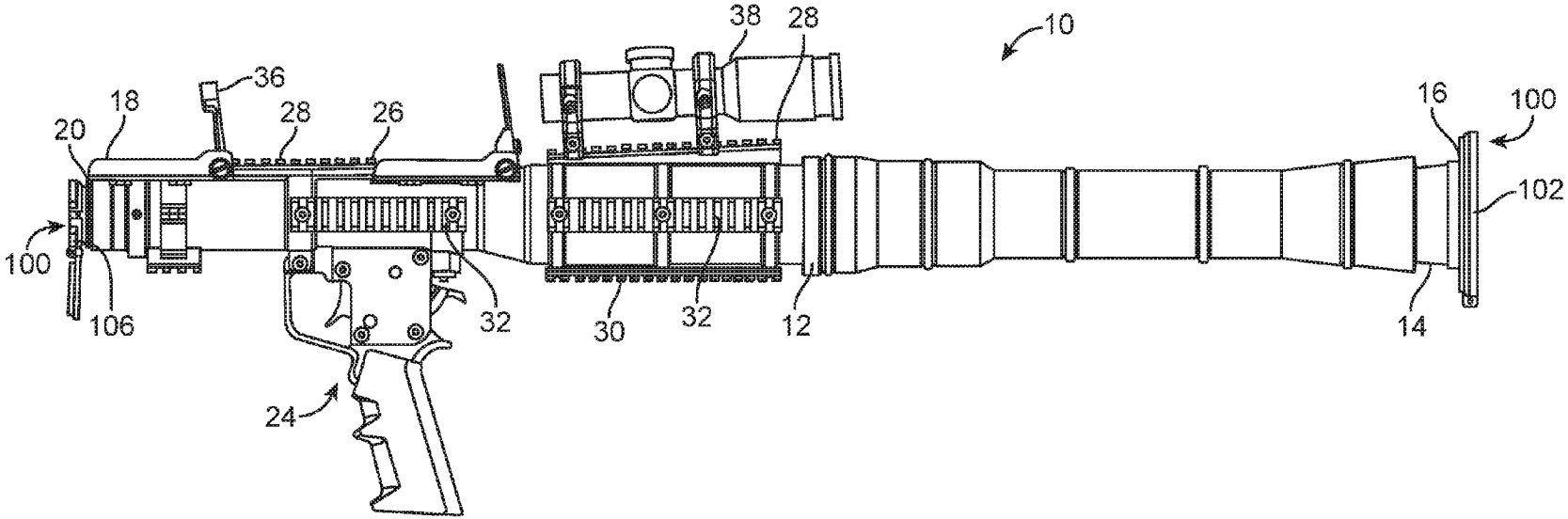
FIG. 1 is an elevational view of an example of a RPG launcher having a debris control apparatus.

It will be appreciated that for simplicity and clarity of illustration, where appropriate, reference numerals have been repeated among the different figures to indicate corresponding or analogous elements. In addition, numerous specific details are set forth in order to provide a thorough understanding of the examples described herein. However, it will be understood by those of ordinary skill in the art that the examples described herein can be practiced without these specific details. In other instances, methods, procedures, and components have not been described in detail so as not to obscure the related relevant feature being described. Also, the description is not to be considered as limited the scope of the examples described herein. The drawings are not necessarily to scale and the proportions of certain parts have been exaggerated to better illustrate details and features of the present disclosure.

Several definitions that apply throughout this disclosure will now be presented. The term "coupled" is defined as connected, whether directly or indirectly through intervening components, and is not necessarily limited to physical connections. The connection can be such that the objects are permanently connected or releasably connected. The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape or other thing that "substantially" modifies, such that the component need not be exact. For example, substantially cylindrical means that the object resembles a cylinder, but can have one or more deviations from a true cylinder. The terms "comprising," "including" and "having" are used interchangeably in this disclosure. The terms "comprising," "including" and "having" mean to include, but not necessarily be limited to the things so described.

The present technology can be implemented as a debris control apparatus for a rocket propelled grenade (RPG) launcher. The debris control apparatus is for a RPG launcher having a plug configured to be inserted into an opening at a rear end of a tube assembly of the RPG launcher. The plug forming an aperture at about the center thereof. The front cover is configured to be coupled with a front end of the RPG launcher and configured to cover an inlet, at the front end, that receives a rocket propelled grenade. The front cover is configured to provide a pair of cross-hairs and the aperture cooperating to provide a bore sight with the pair of cross-hairs, when a target is provided down range at a predetermined distance, and the front cover and plug cooperatively, when installed, seal the RPG launcher assists in preventing ingress of debris.

The aperture can have a diameter that is sized based on the length of the RPG launcher so as to provide the appropriate field of view for the bore sight. The plug can be configured to be ejected from the RPG launcher upon firing of the rocket propelled grenade. The plug can be a sight plug configured to be inserted into the aperture, thereby sealing the RPG launcher. In other examples, the aperture is configured to remain open at all times. The front cover can include one or more flaps configured to pivot relative to the RPG launcher. The one or more flaps can be a debris cover and a sight cover which has a pair of cross-hairs. The one or more flaps can pivot so as to be below the opening when the RPG launcher is in operation or use. The plug can made of two materials, a soft, pliable outer material and a harder, more rigid inner material that is configured to friction fit in opening of the RPG launcher.

FIG. 1 illustrates an elevational view of a rocket propelled grenade launcher 10 having a debris control apparatus 100. The rocket propelled grenade (RPG) launcher 10 forms a longitudinally extending tube assembly 12. The tube assembly 12 has a rear end 14 forming an opening 16 and a front end 18 forming an inlet 20. The opening 16 and the inlet 20 can each be substantially circular in cross-section. The front end 18 can receive a rocket propelled grenade into the tube assembly 12 via the inlet 20. Exhaust gases from discharge of the rocket propelled grenade are expelled through the opening 16 in the rear end 14 of the tube assembly 12.

The RPG launcher 10 includes a debris control apparatus 100 to seal the tube assembly 12 and prevent the ingress of debris. The debris control apparatus 100 can include a plug 102 configured to be inserted into the opening 16 at the rear end 14. The debris control apparatus 100 can also include a front cover 106 configured to be coupled with the front end 18 and cover the inlet 20. In at least one example, the plug 102 and the front cover 106 are configured to be press fit into the tube assembly 12. In other examples, the plug 102 and the front cover 106 can be threadably engaged with the tube assembly 12, snap fit over the opening 16 and inlet 20, or a combination of threadable engagement, snap fit, or press fit.

The RPG launcher 10 can include a trigger assembly 24 coupled to the tube assembly 12 and a one or more of accessory rails 26. The one or more of accessory rails 26 can couple various firearm and artillery accessories including, but not limited to, iron sights, optical scopes, red dot optics, laser optics, grips, lights, and shoulder straps to the RPG launcher 10. In at least one example, the one or more of accessory rails 26 are picatinny rails disposed on each side of the tube assembly 12. The one or more accessory rails 26 can include one or more of: at least one top rail 28, at least one bottom rail 30, at least one left side rail 32, or at least one right side rail (not visible). In other examples, the RPG launcher 10 can include a single accessory rail 26 or any number of accessory rails.

As illustrated in FIG. 1, the RPG launcher 10 has two sets of picatinny rails including two top rails 28, a bottom rail 30, and two left side rails 32. The RPG launcher 10 can have two right side rails identical to the left side rails 32 disposed on the opposite side of the RPG launcher 10. Each of the two top rails is coupled with a sight mechanism. The top rail 28 located proximate to the front end 18 has an iron sight 36 and the top rail 28 located proximate to the rear end 14 has an optical scope 38.

Figure 2:
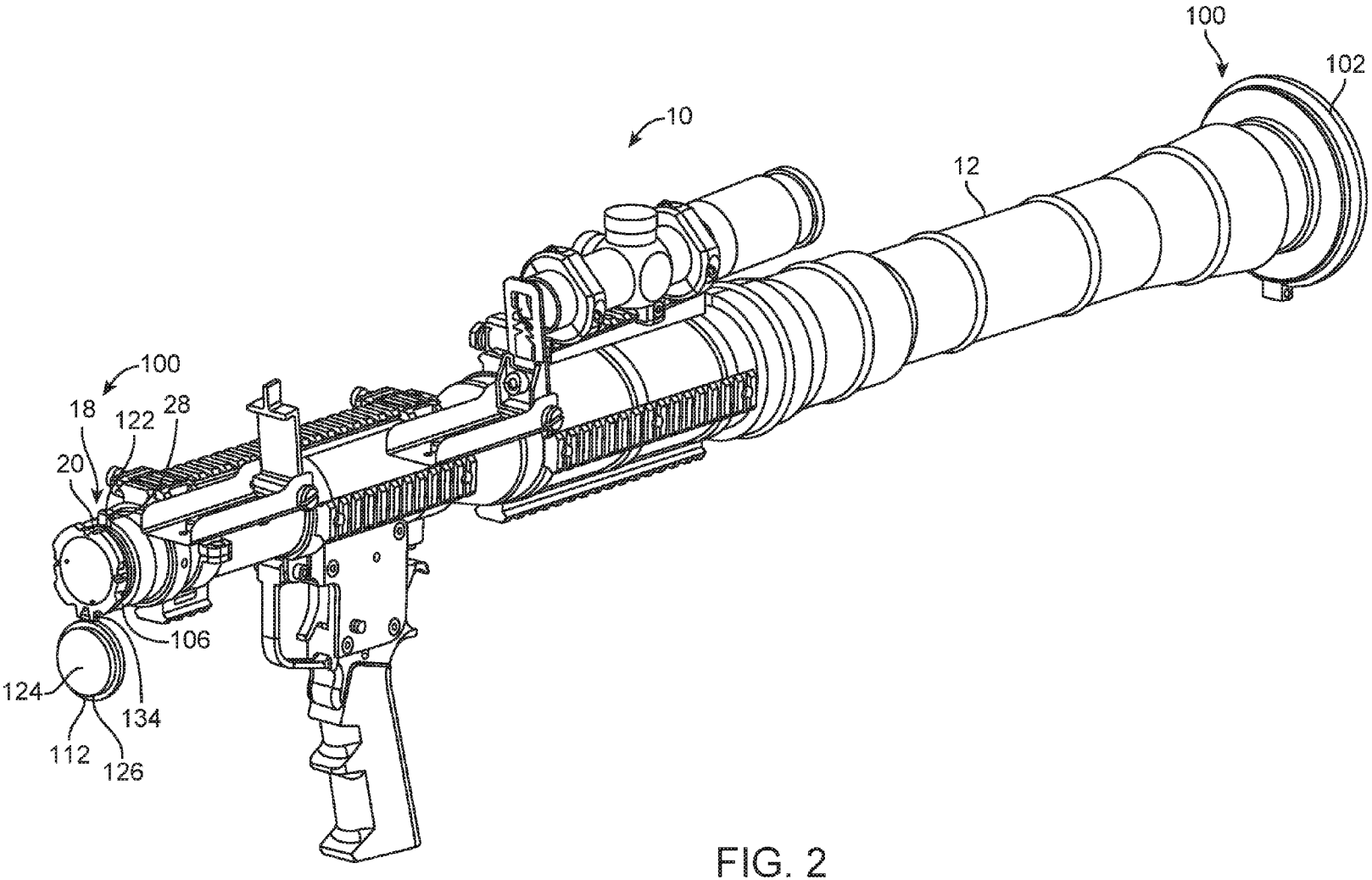
FIG. 2 is an front isometric view of an example of a RPG launcher having a debris control apparatus.

FIG. 2 is a front isometric view of an RPG launcher 10 having a debris control apparatus 100 disposed thereon. The front cover 106 is received in the front end 18 of the tube assembly 12. The front end 18 can have a groove 28 configured to receive a protrusion 122 extending from the front cover 106, thereby aligning the front cover 106 as it is coupled with the front end 18. The front cover 106 can have a flap 112 coupled at a hinge 134. The flap 112 can be any material configured to pivot about a hinge 134 disposed on the bottom side of the front end 18, thereby transitioning the front cover 106 between an open position and a closed position. In the open position, the inlet 20 of the tube assembly 12 is exposed and accessible. The open position allows the RPG launcher 10 to receive RPG, and the flap 112 is displaced away from the inlet 20. In the closed position, the flap 112 of the front cover 106 is pivoted to block the inlet 20 and restrict access, such that an RPG cannot be received by the tube assembly 12. Debris, particulate, and environmental elements are also prevented from entering the inlet 20 of the tube assembly 12 in the closed position. In other examples, the front cover 106 can have more than one flap 112 as will be discussed in more detail with respect to FIG. 12. In at least one example, the flap 112 is substantially similar in shape to the tube assembly 12 and formed from the same material of the front cover 106. In other examples, the flap 112 can be any shape suitable to cover the inlet 20 and composed of any material capable of sealing the inlet 20 from environmental conditions, such as dirt, wind, rain, heat, or particulate.

As can be appreciated in FIG. 2, the flap 112 of the front cover 106 can be substantially larger than the inlet 20. The flap 112 can be molded to have an inner portion 124 configured to be received into the inlet 20 and an outer portion 126 configured to be disposed over the entire front end 18. The inner portion 124 can be received into the inlet 20 and form a pressure fit to secure the front cover 106 in the closed position. The outer portion 126 can be larger than the inner portion 124 to be disposed over the entire diameter of the tube assembly 12. In at least one example, the outer portion 126 is larger than the diameter tube assembly 12 providing a lip extending beyond outer diameter of the front end 18. The lip can assist a user in transitioning the front cover 106 from the closed position to the open position, or the open position to the closed position.

Figure 3:
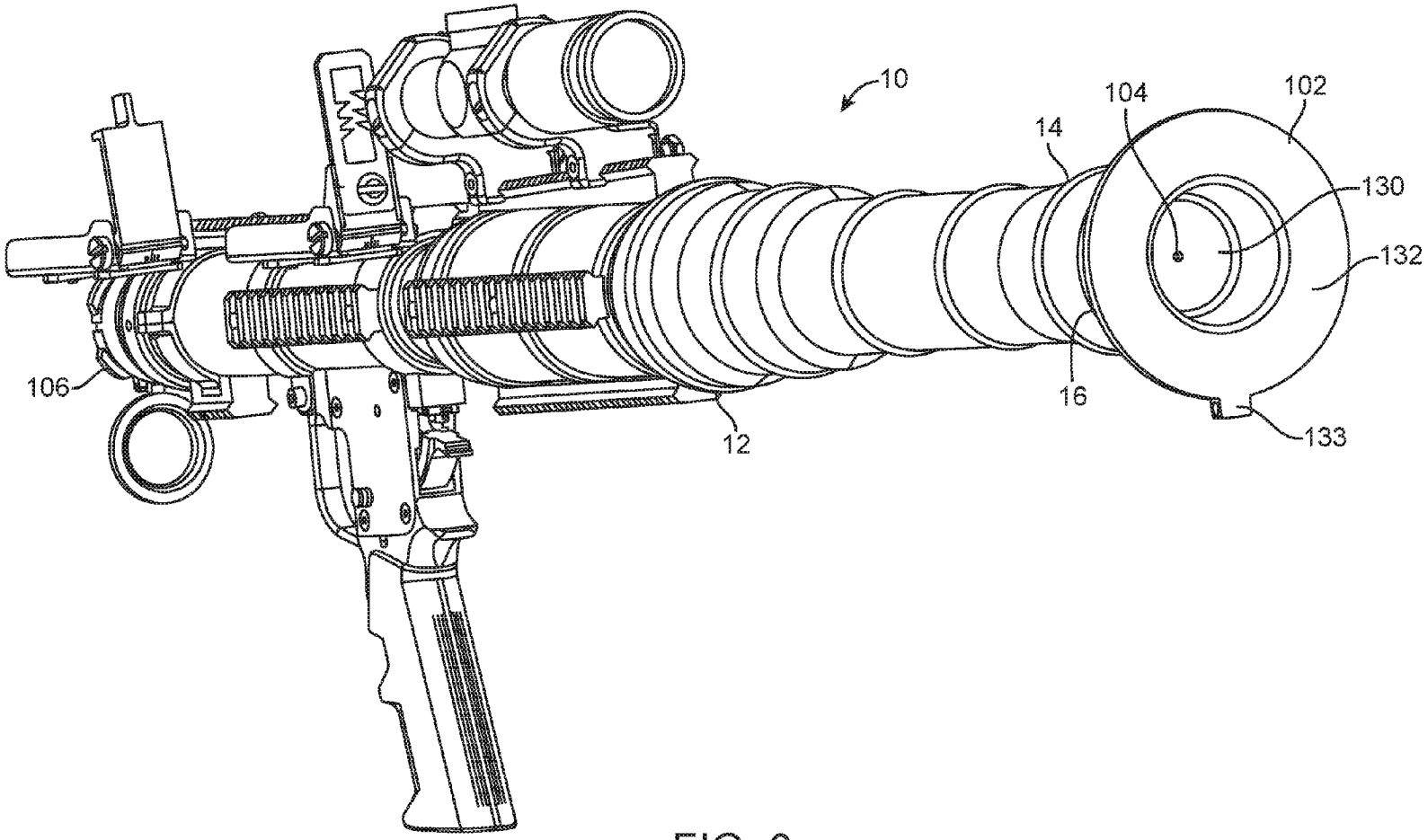
FIG. 3 is a rear isometric view of an example of a RPG launcher having a debris control apparatus.

FIG. 3 illustrates a rear isometric view of an RPG launcher 10. The plug 102 is received into the opening 16 of the rear end 14. In an installed position, the plug 102 covers the opening 16 in the rear end 14 of the tube assembly 12, thereby preventing debris and environmental conditions form entering the tube assembly 12. In an uninstalled position, the plug 102 is removed from the tube assembly 12 and the opening 14 is exposed to environmental conditions. In at least one example, in the uninstalled position the plug 102 is completely decoupled from the RPG launcher 10. In another example, an attachment fitting 133 can be provided on the plug 102. The attachment fitting 133 can be configured to receive an affixment component (not shown) that couples the plug 102 to the RPG 10. The affixment component can include a pivot, a rope, string, a pinned connection, a fastener, or another component that is configured to keep the plug 102 together with the RPG launcher 10. Additionally, it at least one example, the attachment fitting 133 can be configured to accommodate a sling.

The plug 102 can have an aperture 104 formed therein at about the center. The aperture 104 can be aligned with the longitudinal axis of the tube assembly 112. The aperture 104 can have a diameter that is sized based on the length of the RPG launcher 10 so as to provide the appropriate field of view for the bore sight 110 (shown in FIG. 7). The aperture 104 can provide a bore sight 110 (shown in FIG. 7) in conjunction with a set of cross hairs 108 (shown in FIGS. 6-8) disposed within the front cover 106. In at least one example, the aperture 104 can receive a sight plug to seal the aperture 104 from the environment when not in use. In other examples, the aperture 104 can have a transparent material diposed therein allowing operation of the bore sight 110 while sealing the aperture 104 from the environment.

The plug 102 can have an inner portion 130 and an outer portion 132. The inner portion 130 is configured to be received into the opening 16 and the outer portion 132 is configured to abut the rear end 14 of the tube assembly 12. The inner portion 130 can be a substantially frustoconical shape to be received in the opening 16 of the tube assembly 12. The frustoconical shape can assist the inner portion 130 in forming a pressure fit between the plug 102 and the RPG launcher 10, while allowing the plug 102 to be centered in the tube assembly 12. In at least one example, the inner portion 130 can form a pressure fit sufficient to secure the plug 102 in the opening 16, but allow ejection of the plug 102 upon firing of the rocket propelled grenade.

The outer portion 132 can be configured to abut the rear end 14 of the tube assembly 12 and form a seal to prevent debris or environmental conditions from entering the tube assembly 12 through the opening 16. The outer portion 132 can have a diameter larger than the rear end 14, thus providing a lip extending beyond the outer diameter of the rear end 14. The lip can assist a user in transitioning the plug 102 from the installed position to the uninstalled position, or the uninstalled position to the installed position. In at least one example, the inner portion 130 and the outer portion 132 of the plug 102 can be made from the same material. In other examples, the inner portion 130 and the outer portion 132 can be co-molded from different materials, such as the inner portion 130 being a hard, rigid material and the outer portion 132 being a soft, pliable material. In yet other examples, the inner portion 130 and the outer portion 132 can be a stiff rubber or like material.

Figure 4:
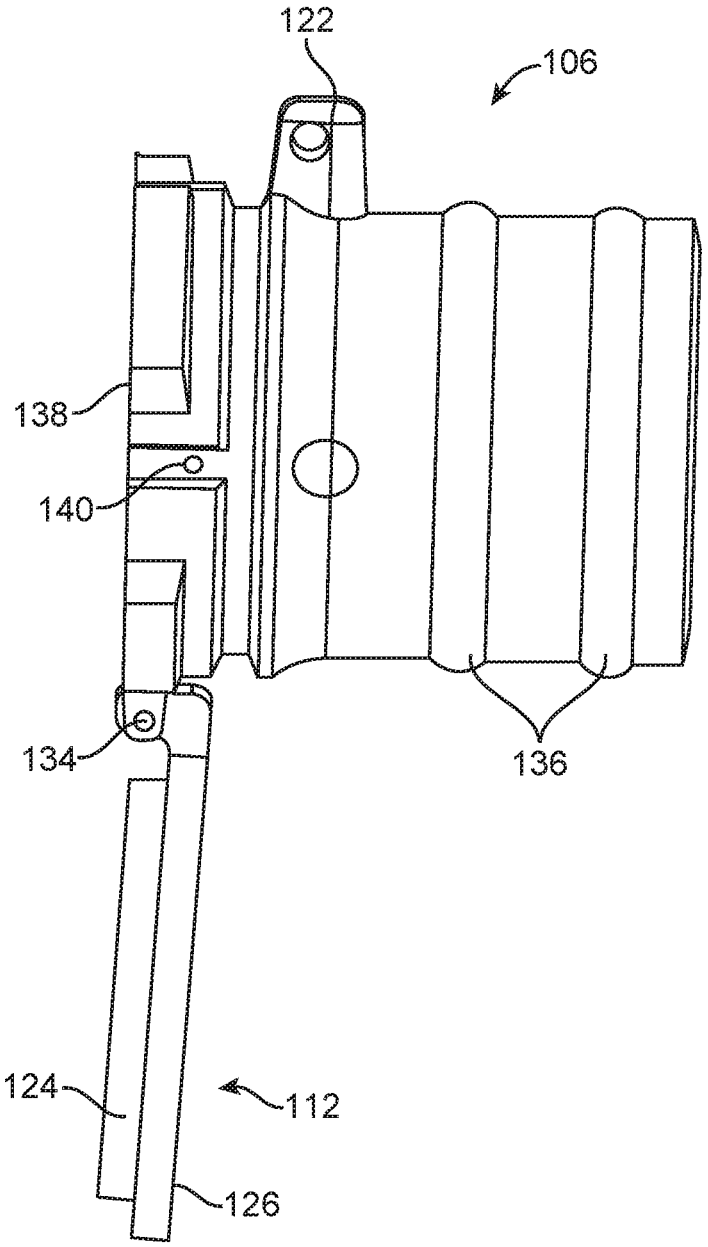
FIG. 4 is an elevational view of an example of a front cover of a debris control apparatus in a down position.

FIG. 4 illustrates an elevational view of a front cover 106 in an open position. The front cover 106 can be receivable into the front end 18 of an RPG launcher 10 (shown in FIGS. 1-2). The front cover 106 has the protrusion 122 to guide and align the front cover 106 as it is received into the inlet 20 of the front end 18. The protrusion 122 is received within a corresponding groove 28 (shown in FIGS. 1-2). The protrusion 122 can further abut the end of groove 28 to prevent inserting the front cover 106 too far into the inlet 20. The front cover 106 can have one or more ribs 136 configured to engage the interior surface of the inlet 20 and provide a friction fit of the front cover 106 within the inlet 20 of the tube assembly 12. The one or more ribs 136 can be made from materials similar to the front cover 106, or be co-molded as a hard or firm material. As illustrated in FIG. 4, the front cover 106 has two ribs 136. In other examples, the front cover 106 can have one, three, four, or any number of ribs 136 to secure the front cover 106 into the inlet 20.

The front cover 106 has a distal end 138 opposite the portion receivable in the front end 18. The distal end 130 can have four holes 140 formed therein are configured to provide a set of cross hairs 108. Two of the four holes 140 are configured to align horizontally across the center point of the front cover 106 to receive a first cross hair 107, and two of the holes 140 are configured to align vertically across the center point of the front cover a second cross hair 109. In at least one example, the four holes 140 are configured to receive a length of string therethrough to create a set of cross hairs 108 within the front cover 106.

The front cover 106 can have a pivoting flap 112 coupled at the hinge 134. The pivoting flap 112 can transition the front cover 106 between the open position and the closed position. The flap 112 is formed by the inner portion 124 and the outer portion 126. The inner portion 124 configured to be received into the distal end 138 of the front cover 106 and the outer portion 124 configured to cover the entire distal end 138 of the front cover 106.

Figure 5:
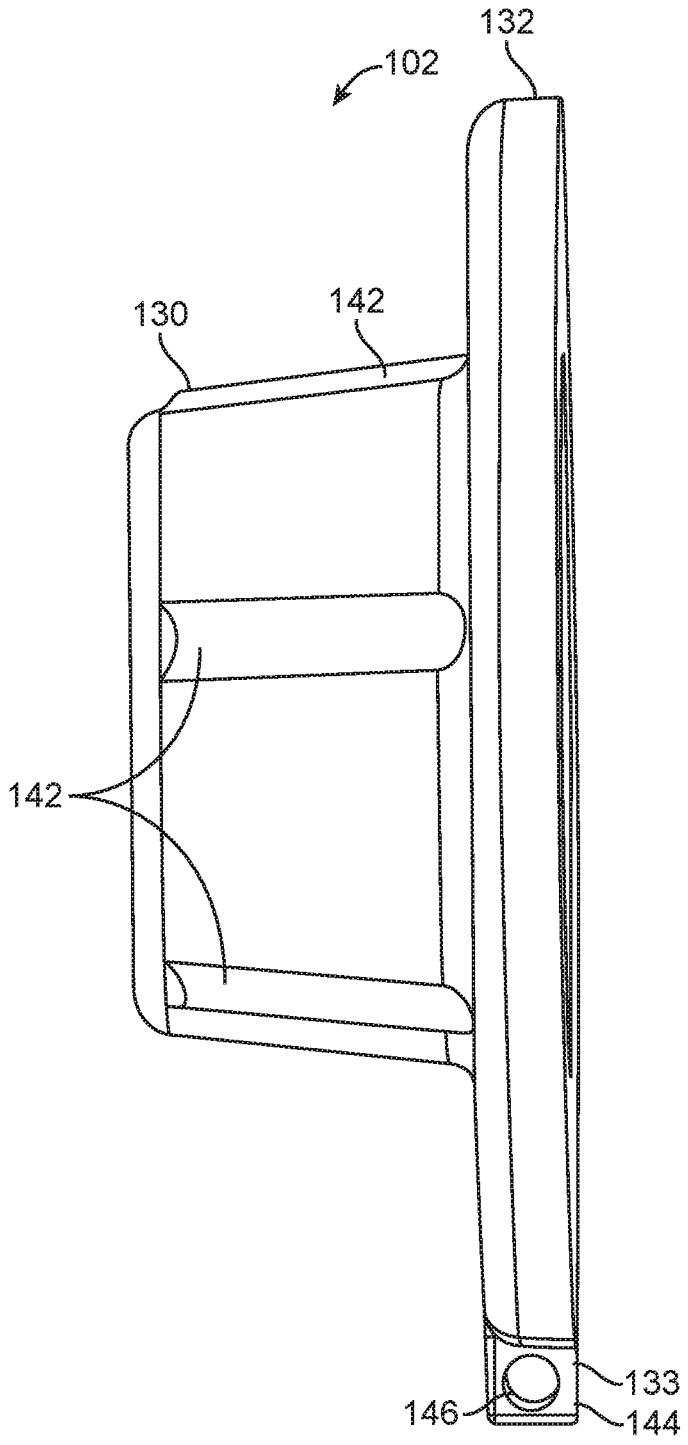
FIG. 5 is an elevational view of an example of a plug of a debris control apparatus.

FIG. 5 illustrates an elevational view of a plug 102 in an uninstalled position. The inner portion 130 of plug 102 can have a plurality of exterior ridges 142 configured to secure and align the plug 102 within the rear end 14 of the RPG launcher 10. The exterior ridges 142 can be disposed around the outer surface of the inner portion 130 and configured to interact with and engage the inner surface of the tube assembly 12. The inner portion 130 can have any number of exterior ridges 142, so long as they are evenly distributed and configured to center the plug 102 within the tube assembly 12. In at least one example, the plug 102 is made from a smooth material and the plurality of exterior ridges 142 are formed from a high friction material.

The plug 102 can also include a flange 144 having an attachment aperture 146 formed therein. The flange 144 and attachment aperture 146 can collectively allow coupling of the plug 102 with the RPG launcher 10. The flange 144 and attachment aperture 146 can be a portion of the attachment fitting 133 or can be independent of the attachment fitting 133. In at least one example, a string or rope can be threaded through the attachment aperture 146 and disposed around the tube assembly 12, such that when in an uninstalled position the plug 102 is still coupled with the RPG launcher 102 by the string or rope. In other examples, the attachment aperture 146 can receive a hinge similar to the front cover 106 configured to allow the plug 102 to pivot between an installed and uninstalled configuration.

Figure 6:
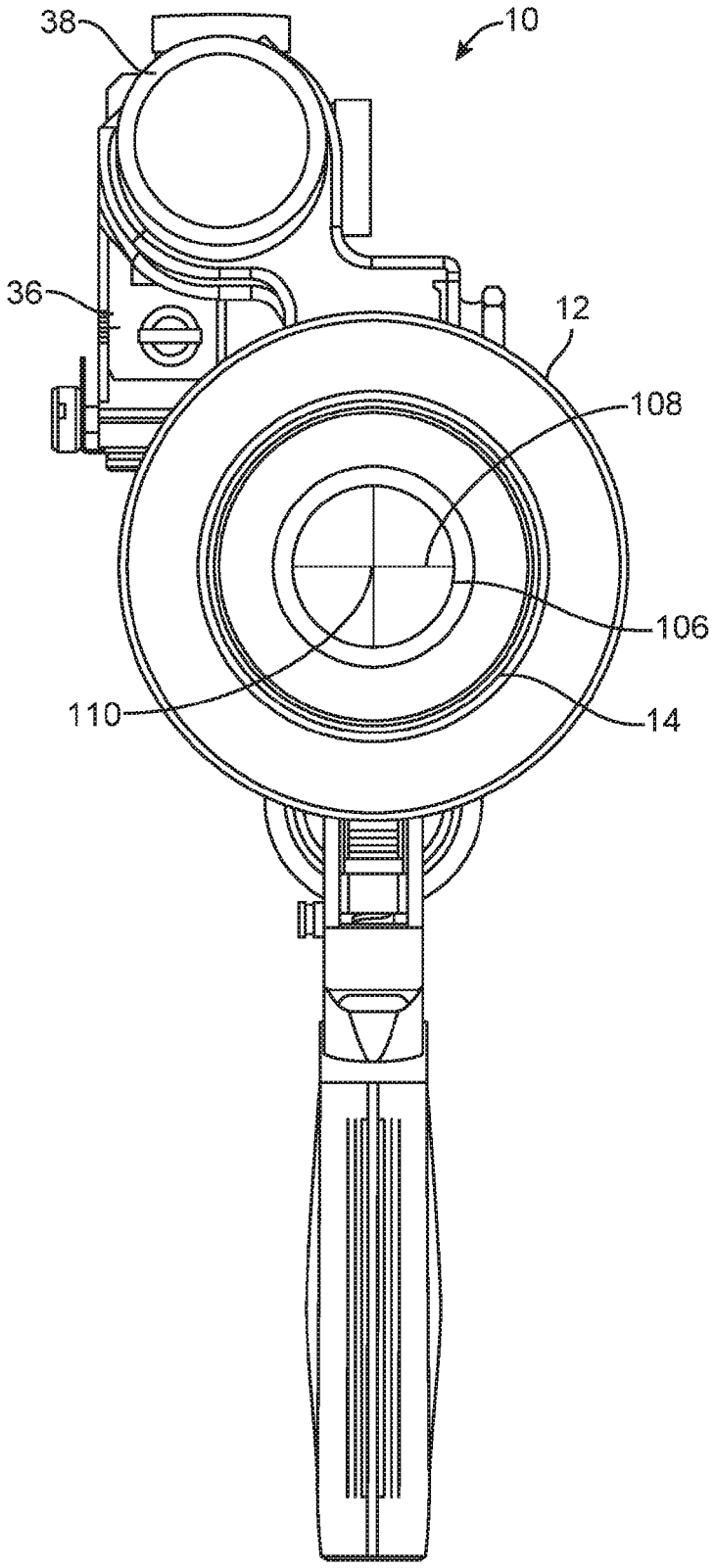
FIG. 6 is a rear view of an example of a RPG launcher having a front cover of a debris control apparatus.

FIG. 6 illustrates a rear view of an RPG launcher 10 having a front cover 106 in an up position and no plug 102. The debris control apparatus 100 can assist in providing a bore sight 110 in order to properly sight the RPG launcher 10. The bore sight 110 can align the center of the tube assembly 12 (for example, where the RPG launcher 10 is pointing) with a target at a predetermined distance. With the RPG launcher 10 pointing at the predetermined target, the iron sights 36, optical scope 38, or other sight mechanism can be sighted to point at the same location. The bore sight 110 ensures, at the predetermined distance, the iron sights 36, optical scope 38, and bore sight 110 each point at the same location. As can be appreciated in FIG. 6, the set of cross hairs 108 of the front cover 106 are visible through the rear end 14 of the tube assembly 12. The set of cross hairs 108 can be configured to be implemented such that the bore sight 110 is based on the aperture 104 in the plug 102.

Figure 7:
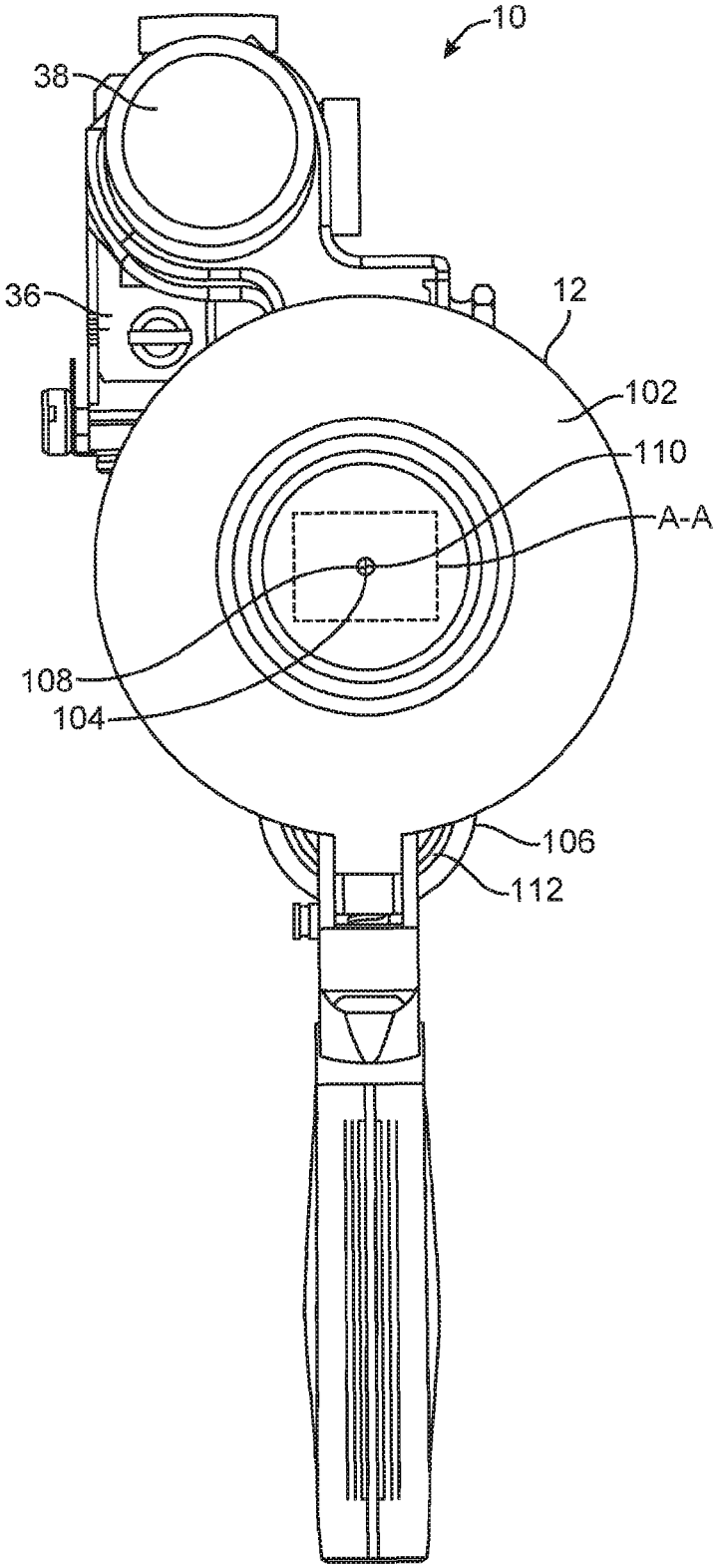
FIG. 7 is a rear view of an example of a RPG launcher having a debris control apparatus.

FIG. 7 illustrates a rear view of an RPG launcher 10 having a debris control apparatus 100 including a front cover 106 and a plug 102. As can be appreciated in FIG. 7. the set of cross hairs 108 is visible through the aperture 104 in the plug 102. The aperture 104 is formed so as to align with the center of the tube assembly 12, thus providing a bore sight 110. Aligning the aperture 104 with the center of the cross hairs 108 and a predetermined target provides an accurate bore sight 110 for the RPG launcher 10. The iron sights 36 and optical scope 38 can then be adjusted to align with the bore sight 110.

Figure 8:
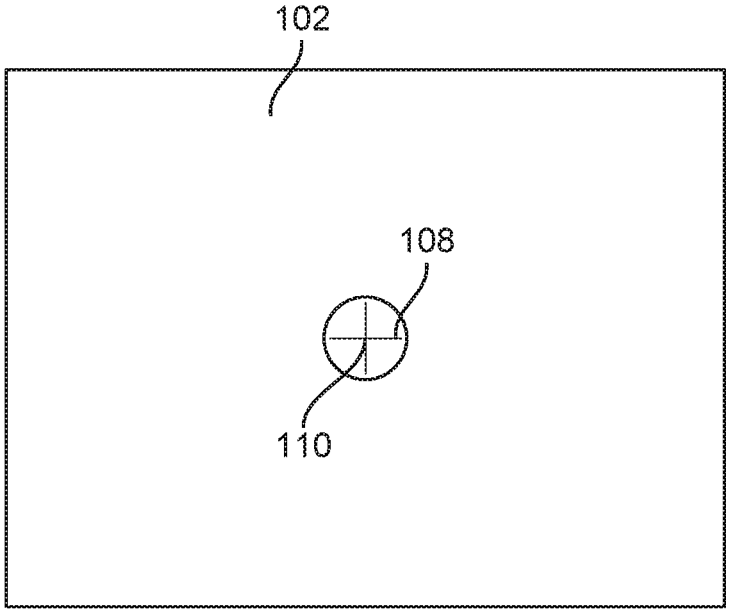
FIG. 8 is an enlarged view of section A-A of FIG. 7.

FIG. 8 illustrates an enlarged view of section A-A of the RPG launcher 10 of FIG. 7. As can be further appreciated in FIG. 8, aligning the aperture 104 with the cross hairs 108 provides a bore sight 110. The bore sight 110 allows exterior sight mechanisms, such as iron sights 36 and optical scope 38 to be sighted to a predetermined target at a predetermined distance. The bore sight 110 can allow adjustment of the sight mechanisms for targets at various predetermined distances.

Figure 9:
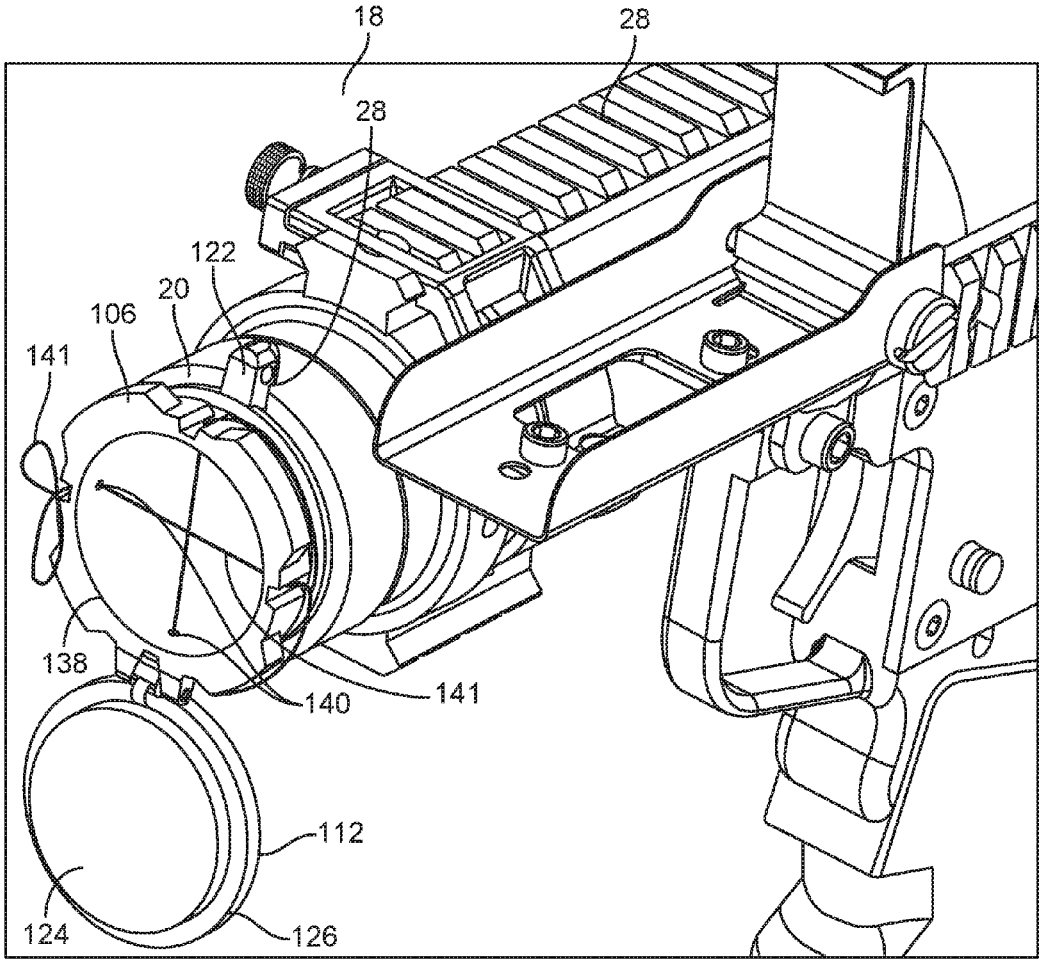
FIG. 9 is a front isometric view of an example of a front cover of a RPG launcher in a down position.

FIG. 9 illustrates a front isometric view of a front cover 106 of a debris control apparatus 100 in a down position and disposed on an RPG launcher 10. The front cover 106 is received in the front end 18 of the tube assembly 12. The protrusion 122 of the front cover 106 is received within the groove 28 formed in the front end 18 of the tube assembly 12. The four holes 140 are disposed in the front cover 106 and configured to form a set of cross hairs 108. The flap 112 is pivotably coupled with front cover 106 to transition between the up position and the down position. As illustrated in FIG. 9, the flap 112 is in the down position, and the inlet 20 formed in the front end 18 is exposed to environmental conditions and capable of receiving a rocket propelled grenade. A set of cross hairs 108 is formed by a length of string 141 passing through the two horizontally aligned holes and passing through the two vertically aligned holes of the four holes 140.

Figure 10:
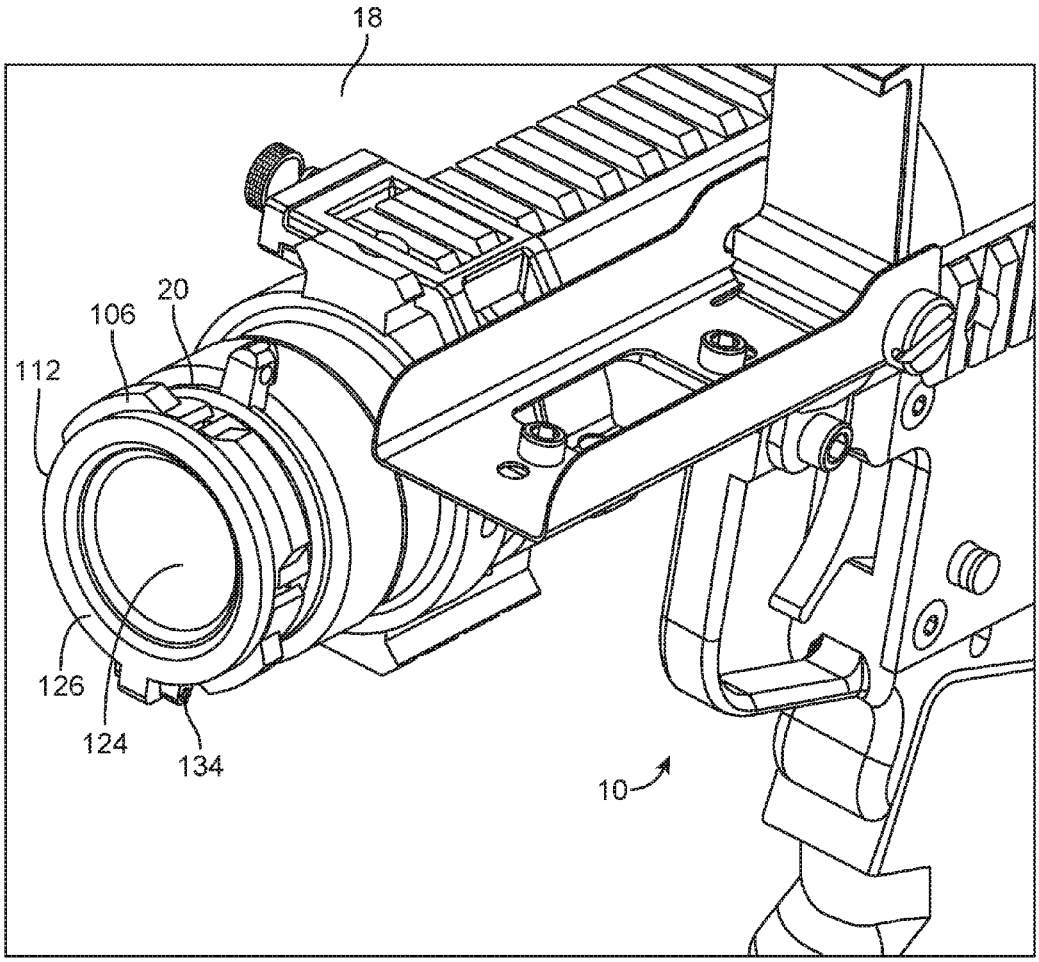
FIG. 10 is a front isometric view of an example of a front cover of a RPG launcher in an up position.

FIG. 10 illustrates a front isometric view of a front cover 106 of a debris control apparatus 100 in an up position and disposed on a rocket propelled grenade launcher. The front cover 106 in the up position extends complete over and around the inlet 20. The front end 18 and inlet 20 are sealed from environmental conditions and prevented from receiving a rocket propelled grenade. The up position prevents water, sand, dirt, and other environmental conditions from entering the tube assembly 12 via the inlet 20. The flap 112 covering the inlet 20 is be pivoted about hinge 134 between the down position (shown in FIG. 9) and the up position. The pivotable coupling of the flap 112 with the front cover 106 prevents the flap 112 from being misplaced and/or lost.

Figure 11:
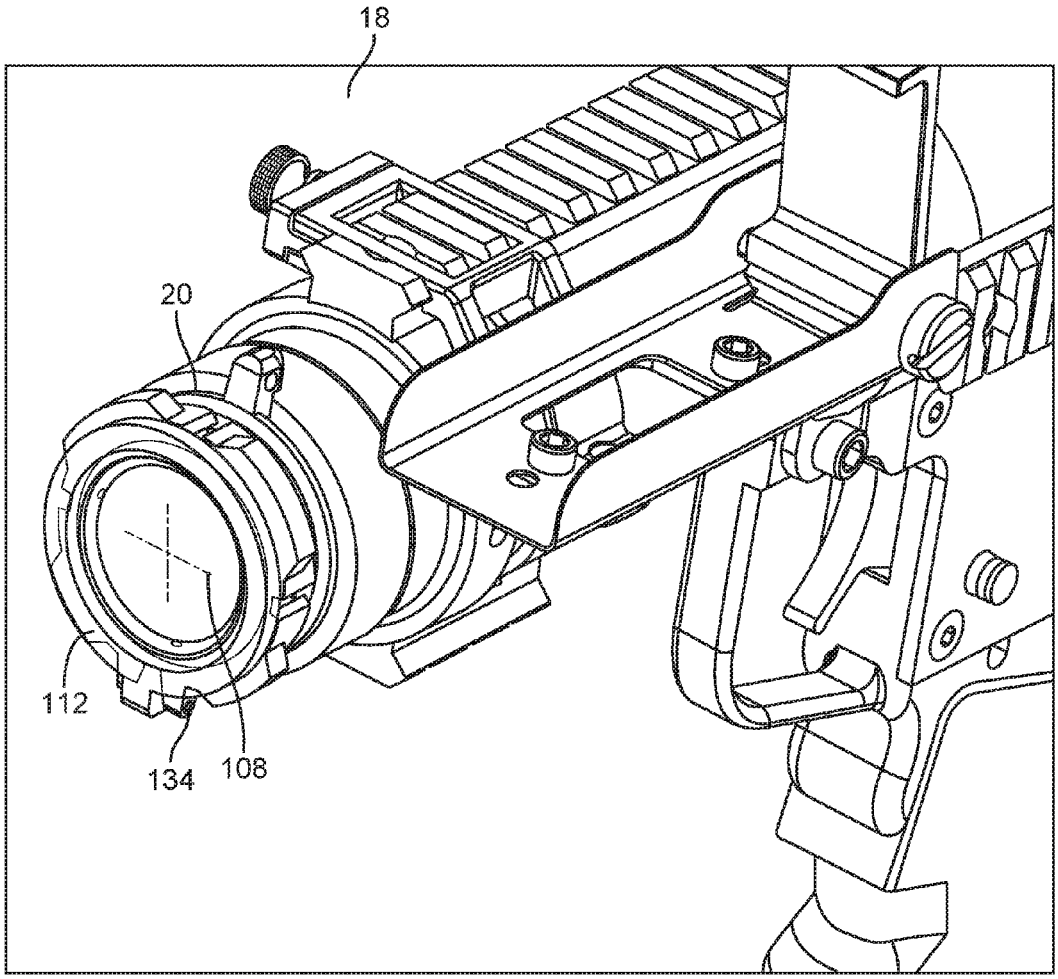
FIG. 11 is a front isometric view of a second example of a front cover of a RPG launcher in an up position.

FIG. 11 is front isometric view of a front cover 106 in an up position and disposed on a rocket propelled grenade launcher 10. The front cover 106 can be molded from a clear or transparent material such as optical glass, polycarbonate, or similar plastics. The front cover 106 can have a set of cross hairs 108 disposed thereon or therein to be viewed via the bore sight 110. The cross hairs 108 contrast the transparent front cover 106 allowing a bore sight of the RPG launcher 10 while front cover 106 is in the up position. The tube assembly 12 of the RPG launcher 10 is protected from environmental conditions and the sight mechanisms can be adjusted based on the bore sight while the front cover 106 is in the up position.

Figure 12:
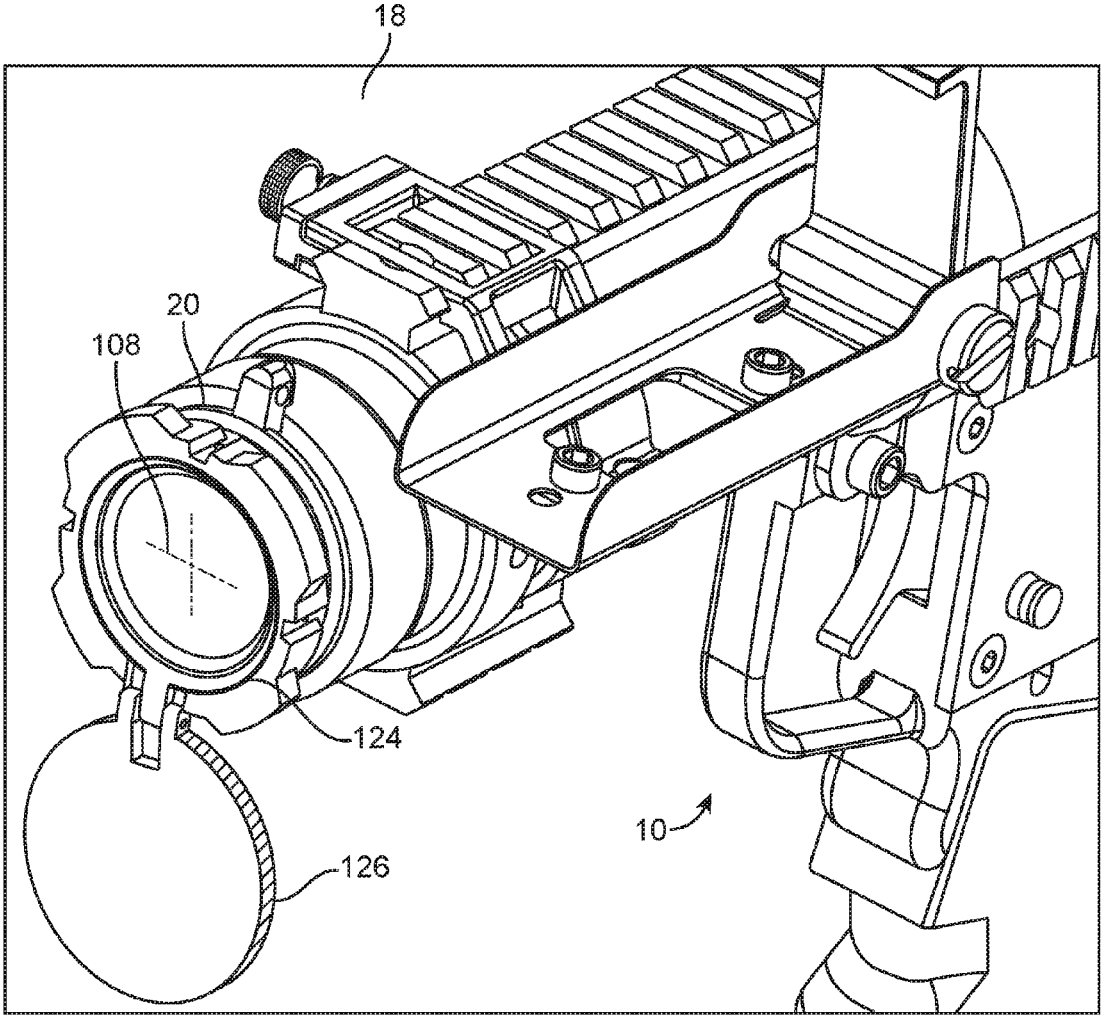
FIG. 12 is front isometric view of a third example of a front cover of a RPG launcher in an up position.

FIG. 12 is front isometric view of a front cover 106 of a debris control apparatus 100 in a partially up position and disposed on a rocket propelled grenade launcher. The front cover 106 can have more than one flap 112. In at least one example, the front cover 106 includes two flaps 112; a debris cover 114 and a sight cover 116. The debris cover 114 and the sight cover 116 are coupled to the front cover 106 at hinge 134. The debris cover 114 and the sight cover 116 are separately pivotable relative to each other and the front cover 106.

The debris cover 114 can be a solid material to protect the front end 18, inlet 20, and sight cover 116 from environmental conditions. The debris cover 114 can configured to fit over the sight cover 116 and front end 18 of the tube assembly 12. The debris cover 114 can extend around the sight cover 116 so as to allow both flaps 112 to pivot about the same hinge 134. The sight cover 116 can have a flange 118 that extends from the hinge 134 approximately the thickness of the tube assembly 12 to allow proper engagement with the inlet 20.

The sight cover 116 can be a transparent material such as polycarbonate and configured to provide a set of cross hairs 108. The sight cover 116 can be received into the inlet 20 and work in conjunction with the plug 102 (shown in FIGS. 1-2) to bore sight 110 the RPG launcher 10. The sight cover 116 can substantially seal the tube assembly 12 from environmental conditions. During operation of the RPG launcher 10, both the sight cover 116 and the debris cover 114 are disposed in a down position. During bore sight 110, the sight cover 116 is in an up position while the debris cover 114 is in a down position. During debris control, the debris cover 114 and sight cover 116 are both in the up position.

It is believed the examples and advantages will be understood from the foregoing description, and it will be apparent that various changes may be made thereto without departing from the spirit and scope of the disclosure or sacrificing all of its advantages.

What is claimed is:

1. A debris control apparatus for a rocket propelled grenade launcher comprising:

a plug configured to be inserted into an opening at a rear end of a tube assembly of the rocket propelled grenade launcher, the plug forming an aperture at about the center thereof;

a front cover configured to be coupled with a front end of the rocket propelled grenade launcher and configured to cover an inlet, at the front end, that receives a rocket propelled grenade;

wherein the front cover is configured to provide cross-hairs and the aperture cooperating to provide, when a target is provided down range at a predetermined distance, a bore sight with the cross-hairs and the front cover and plug cooperatively, when installed, seal the rocket propelled grenade launcher assists in preventing ingress of debris.

2. The debris control apparatus as recited in claim 1, wherein the aperture has a diameter that is sized based on the length of the rocket propelled grenade launcher so as to provide the appropriate field of view for the bore sight.

3. The debris control apparatus as recited in claim 1, wherein the plug is configured to be ejected from the rocket propelled grenade launcher upon firing of the rocket propelled grenade.

4. The debris control apparatus as recited in claim 1, further comprising a sight plug configured to be inserted into the aperture.

5. The debris control apparatus as recited in claim 1, wherein the front cover further comprises one or more flaps configured to pivot relative to the rocket propelled grenade launcher.

6. The debris control apparatus as recited in claim 5, wherein the one or more flaps includes a debris cover and a sight cover which includes the pair of cross-hairs.

7. The debris control apparatus as recited in claim 6, wherein the sight cover is configured to be transparent and have cross-hairs visible thereon.

8. The debris control apparatus as recited in claim 7, wherein the debris cover is configured to be mounted exterior to the sight cover.

9. The debris control apparatus as recited in claim 5, wherein the one or more flaps pivot so as to be below the opening.

10. The debris control apparatus as recited in claim 1, wherein the plug is made of two materials, a soft, pliable outer material and a hard inner material that is configured to friction fit in the rocket propelled grenade launcher.

11. The debris control apparatus as recited in claim 1, wherein the tube assembly forms four holes at the front end, the four holes being configured to receive one of rope, string, or wire, so that crosshairs can be formed at the front end by the one of rope, string, or wire.

12. The debris control apparatus as recited in claim 1, wherein the plug includes an attachment fitting that is configured to retain the plug to the RPG.

13. The debris control apparatus as recited in claim 1, wherein the plug includes a plurality of ridges.

14. The debris control apparatus as recited in claim 1, wherein the plug includes an inner portion and an outer portion, the inner portion is configured to be received into the opening.

15. The debris control apparatus as recited in claim 14, wherein the inner portion is substantially frustoconical shaped.

16. The debris control apparatus as recited in claim 14, wherein the outer portion has a diameter that is larger than the rear end of the tube.

17. The debris control apparatus as recited in claim 14, wherein the inner portion and outer portion are comolded.

18. The debris control apparatus as recited in claim 14, wherein the inner portion forms a plurality of exterior ridges thereon.

* * * * *